US011406227B2

(12) United States Patent
Denton et al.

(10) Patent No.: US 11,406,227 B2
(45) Date of Patent: Aug. 9, 2022

(54) NEONATAL BATH TUB WITH STABILIZING BACKREST

(71) Applicant: Catapult Products, LLC, Salt Lake City, UT (US)

(72) Inventors: Dana L. Denton, Salt Lake City, UT (US); Daniel B. Blanchard, Bountiful, UT (US); Marshall T. Denton, Salt Lake City, UT (US)

(73) Assignee: Catapult Products, LLC, Salt Lake City, UT (US)

( * ) Notice: Subject to any disclaimer, the term of this patent is extended or adjusted under 35 U.S.C. 154(b) by 0 days.

(21) Appl. No.: 17/216,507

(22) Filed: Mar. 29, 2021

(65) Prior Publication Data

US 2021/0212522 A1 Jul. 15, 2021

Related U.S. Application Data

(63) Continuation-in-part of application No. 16/091,033, filed as application No. PCT/US2017/025805 on Apr. 3, 2017, now Pat. No. 10,966,576, which is a continuation-in-part of application No. 29/560,762, filed on Apr. 10, 2016, now Pat. No. Des. 786,570.

(51) Int. Cl.
*A47K 3/024* (2006.01)

(52) U.S. Cl.
CPC ..... *A47K 3/024* (2013.01)

(58) Field of Classification Search
CPC ..... A47K 3/024; A47K 3/034; A47K 3/127; A47K 1/06
See application file for complete search history.

(56) References Cited

U.S. PATENT DOCUMENTS

| | | | |
|---|---|---|---|
| 6,112,343 | A | 9/2000 | Dixon |
| 6,578,209 | B2 | 6/2003 | Lopes et al. |
| 6,622,884 | B1 | 9/2003 | Gartner |
| 6,772,800 | B1 | 8/2004 | Garcia |

(Continued)

FOREIGN PATENT DOCUMENTS

| | | |
|---|---|---|
| EP | 1025789 | 8/2000 |
| WO | 2008110950 | 9/2008 |

OTHER PUBLICATIONS

U.S. Appl. No. 29/560,762, filed May 16, 2017, Dana L. Denton et al.

(Continued)

*Primary Examiner* — Janie M Loeppke
(74) *Attorney, Agent, or Firm* — Brian C. Trask

(57) ABSTRACT

A bath tub 100 for neonatal bathing including a backrest 112 that provides support for the baby at an inclined position, and a seat 152 to cooperate with the backrest 112 to flex the baby's hips to suppress the baby's urge to sit up or squirm. Embodiments may include side supports 136, 138 and/or stabilizer ribs 166, 168 to resist baby rotation about the seat 152. The tub 100 may be structured to reduce leverage to the baby to resist baby's turning over during a bath. A drain path 180 is desirably provided to maintain thermal equilibrium in the water during a bath. A system 240 may include a plurality of bathing accessories and a disposable sterile liner 264 to permit reuse of the tub 100, and/or an optional storage bag 268 to store the tub 100, and even a system 240, at a convenient location.

20 Claims, 10 Drawing Sheets

(56) References Cited

U.S. PATENT DOCUMENTS

| | | | | |
|---|---|---|---|---|
| D656,226 | S | 3/2012 | Eerli | |
| 2003/0070219 | A1 | 4/2003 | Lopes et al. | |
| 2005/0066436 | A1 | 3/2005 | Mazar | |
| 2007/0220669 | A1 | 9/2007 | Monti et al. | |
| 2011/0083261 | A1* | 4/2011 | Goergen | A47K 3/127 4/572.1 |
| 2014/0109669 | A1 | 4/2014 | Herold | |
| 2015/0040309 | A1* | 2/2015 | Sundberg | A47K 3/024 4/572.1 |
| 2015/0257609 | A1 | 9/2015 | Daley | |
| 2015/0342417 | A1 | 12/2015 | Malone et al. | |

OTHER PUBLICATIONS

Extended European Search Report, dated Oct. 16, 2020, PCT/US2017025805.

International Search Report and Written Opinion for parent PCT application PCT/US2017/025805, dated Jul. 17, 2017.

http://www.4moms.com/support/bath.

* cited by examiner

NEONATAL BATH TUB WITH STABILIZING BACKREST

RELATED APPLICATIONS

This application is a continuation-in-part of the U.S. utility application Ser. No. 16/091,033, filed Oct. 3, 2018 for "NEONATAL BATH TUB", which is a National Phase Entry of the PCT application Serial No. PCT/US2017/025805, filed on Apr. 3, 2017 for "NEONATAL BATH TUB", and claims the priority benefit of the filing date of United States Design Patent Application Ser. No. 29/560,762, filed Apr. 10, 2016, for "INFANT BATH TUB", the entire contents of which are all hereby incorporated by reference.

TECHNICAL FIELD

This invention relates to fluid-holding containers. It is particularly directed to a wash tub for neonatal bathing.

BACKGROUND

Small sized containers, or tubs, in which one may wash a baby are commercially available. Certain of such tubs are structured to be placed into a large sink bowel, and are suspended by rim structure of the bowel. Those and others may include a footprint that permits placing the tub onto a table, or other flat surface. Some such tubs include a sling to convert an infant-sized bathing tub for use with a newborn baby.

A relatively new treatment in use in hospitals may be characterized as swaddle bathing. Swaddle bathing is particularly useful for bathing of premature babies, and as a soothing treatment for babies born to substance-abusing mothers. Swaddle bathing encompasses swaddling a baby in a blanket, and placing the bundled baby into a tub of warm water to undergo a cleaning and/or therapeutic bath. Commercially available tubs are not as useful as may be desired for application to swaddle bathing. It would be an improvement to provide a neonatal bath tub that is better suited for application to swaddle bathing, and that may be used for an extended period of time as a baby develops.

DISCLOSURE OF THE INVENTION

This invention provides a fluid-holding tub with a floor and an open top disposed opposite the floor. Certain tubs include rounded corners to suggest a generally oval plan form shape. A workable tub may be structured to permit stacking a plurality of tubs in a reduced volume. Preferred embodiments include a rim projecting generally from a top perimeter of the tub, the rim being structured to facilitate lifting the tub and a full load of water. Desirably, a spout is disposed at a corner, or other convenient position, to facilitate emptying the tub. Certain internal structures of the tub can be rounded to avoid crannies and configured and arranged to resist providing leverage to a baby's feet to avoid the baby turning over during bathing.

In certain cases, a step is formed in a portion of a tub wall or floor to provide an instrument surface that is offset from a support surface on which the tub is placed during use of the tub to wash the baby. A thermometer may be affixed to the instrument surface to permit a user to see the thermometer while washing the baby.

Preferred tub embodiments include a sloping backrest with a support surface configured to support a baby at a defined inclined orientation inside the tub. A preferred backrest provides a firm surface against which the baby's back may be urged. In contrast, a sling or hammock-style backrest provides an accommodating surface that promotes curving the baby, or urging the baby toward a slumping posture.

One workable backrest includes a first side support and a second side support, the first and second side supports being spaced-apart on opposite sides of a tub length center-line and operable to resist rotation of the baby in a plane approximately parallel to the backrest support surface and about an axis defined by a seat. Workable embodiments of the first and second side supports typically project by a maximum distance of between about ½ inch and about 6 inches from the support surface of the backrest. Sometimes, the first and second side supports project from the surface of the backrest by a non-uniform distance along their length axes.

Some backrests may include a first stabilizer rib and a second stabilizer rib, the first and second stabilizer ribs being spaced-apart on opposite sides of a tub length center-line and disposed between the first and second side supports. Desirably, stabilizer ribs are structured to enhance tub accommodation for a larger range in baby size by helping to support smaller babies, and don't get in the way or interfere with comfort of larger babies. Typically, the first and second stabilizer ribs project by a maximum distance of between about ¼ inch and about 1 inch from the support surface of the backrest. Sometimes the first and second stabilizer ribs project from the surface of the backrest by a non-uniform distance along their length axes.

The top of a currently preferred backrest is structured to blend smoothly into a top of a tub wall to avoid creating an interference with the heads of babies having different sizes (e.g. tall babies). Also, it is preferred for a bottom of the backrest to be structured to blend into the floor of the tub, and at least one of the first side support and second side support to be spaced apart from an associated seat to form a drain space to resist creating a stagnant pool of fluid in which the baby sits during a bath. Such a drain space provides a fluid flow path to facilitate maintenance of thermal equilibrium in all of the fluid confined in the tub. A preferred embodiment includes side supports being spaced apart from side walls of the tub to define extended water-holding channels at each side of the baby. The extended channels increase the holding capacity of the tub, and thereby, help to maintain water temperature over an extended period of time.

Desirably, a seat is disposed to hold the baby at a hip-flexed position with respect to the backrest. One workable seat includes an integral leg rest configured to flex the knees of the baby. A currently preferred seat defines an arcuate shape projecting symmetrically in opposite directions from the tub center-line and generally parallel to the floor. Preferably, the baby-support surface of a seat, at a section taken parallel to the tub floor, is concave.

An exemplary tub has a length of less than about 30 inches, a width of less than about 24 inches, and a depth of less than about 10 inches. A preferred embodiment has a plan form suggesting an ovaloid with a major axis length of about 23 inches, a minor axis length of about 18 inches, and a depth of about 6½ inches. A workable tub may be manufactured from plastic, and can have a generally uniform tub wall thickness of about 0.1 inches, more or less. Workable plastics include polypropylene, polyethylene, PVC, ABS, and the like.

One embodiment provides a system for neonatal bathing. An exemplary such system may include one or more of the following: a swaddle blanket; a container sized to hold a quantity of rinse water in reserve and to fit inside a neonatal tub such that the rinse water remains substantially at the temperature of the bath water; a quantity of wash soap; a scalp brush; a neonatal-sized wash cloth; a disposable waterproof liner to fit the neonatal tub; and a storage bag sized to contain the system and a neonatal tub, the storage bag being structured to permit hanging or otherwise placing the storage bag at a convenient location when the storage bag is holding the system and a neonatal tub.

A workable swaddle blanket may be made from a double-sided acrylic fleece material, and the like. A preferred size for a swaddle blanket is about 18 inches by about 21 inches. The workable length and width may vary from such sizes by perhaps plus 10 inches and minus 6 inches, or so. It should be noted that a neonatal-sized wash cloth is smaller in size than a conventional wash cloth, which is about 10 to 12 inches; typically square. An exemplary neonatal-sized wash cloth is sized about 4 inches square. However, a neonatal-sized washcloth may be smaller or larger, up to perhaps 6 inches by 6 inches, or so. Further, a neonatal-sized washcloth is not required to be square.

BRIEF DESCRIPTION OF THE FIGURES

In the drawings, which illustrate what are currently considered to be the best modes for carrying out the invention.

Figure 1:
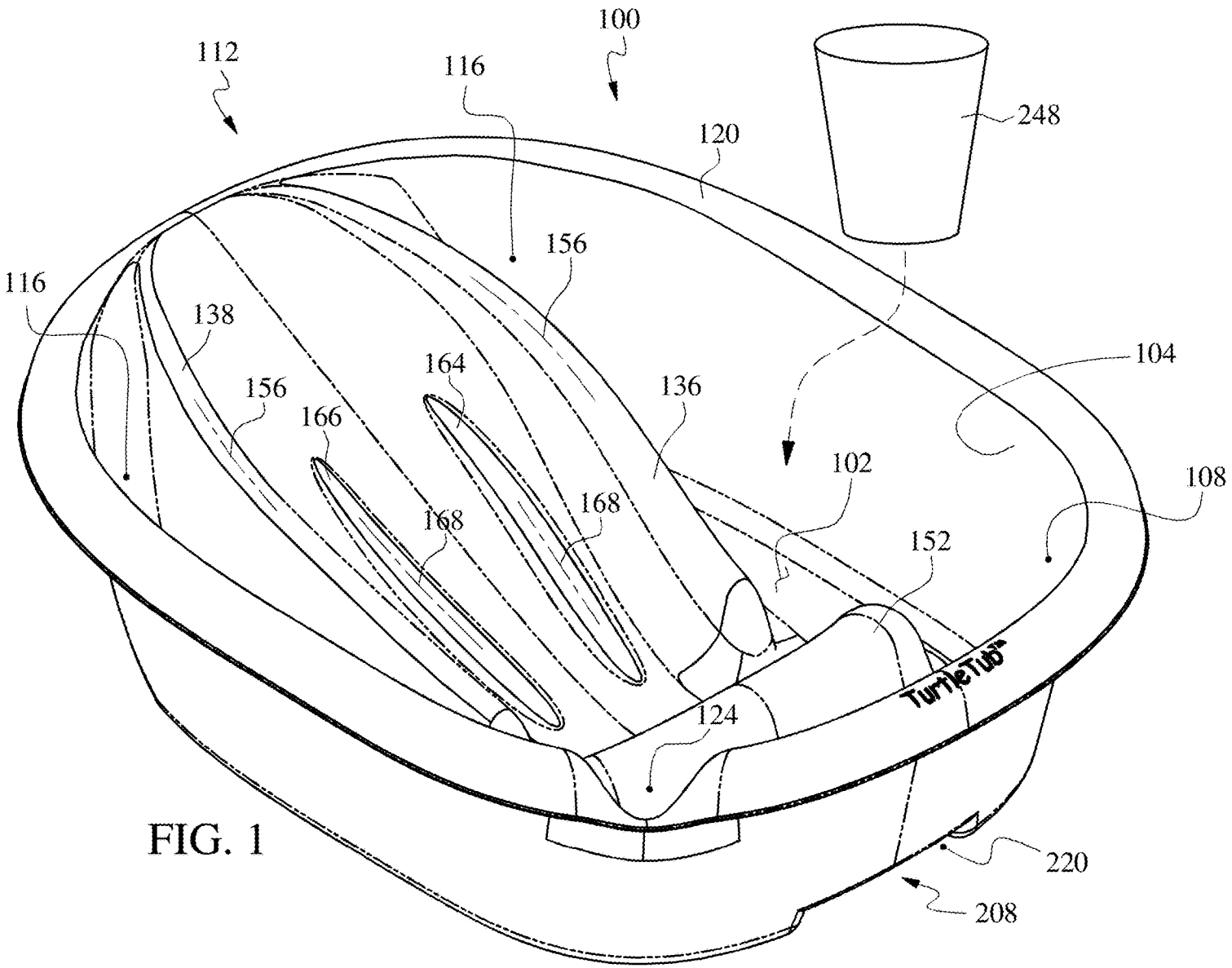
FIG. 1 is an isometric view in perspective from above of an embodiment structured according to certain principles of the invention.
Figure 2:
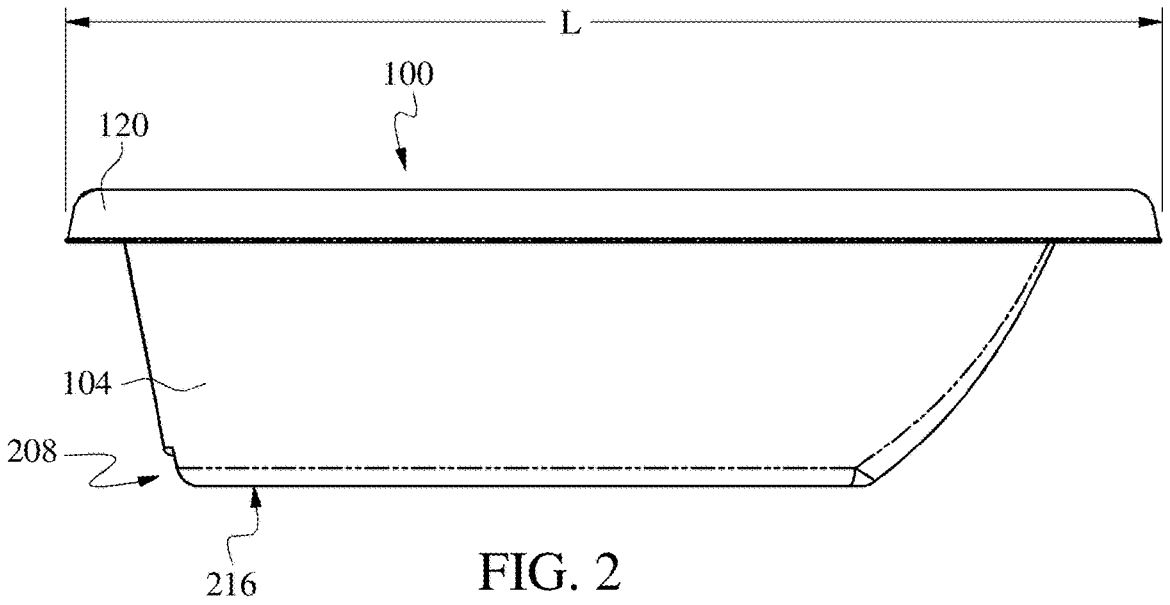
FIG. 2 is a right-side view of the embodiment in FIG. 1.
Figure 3:
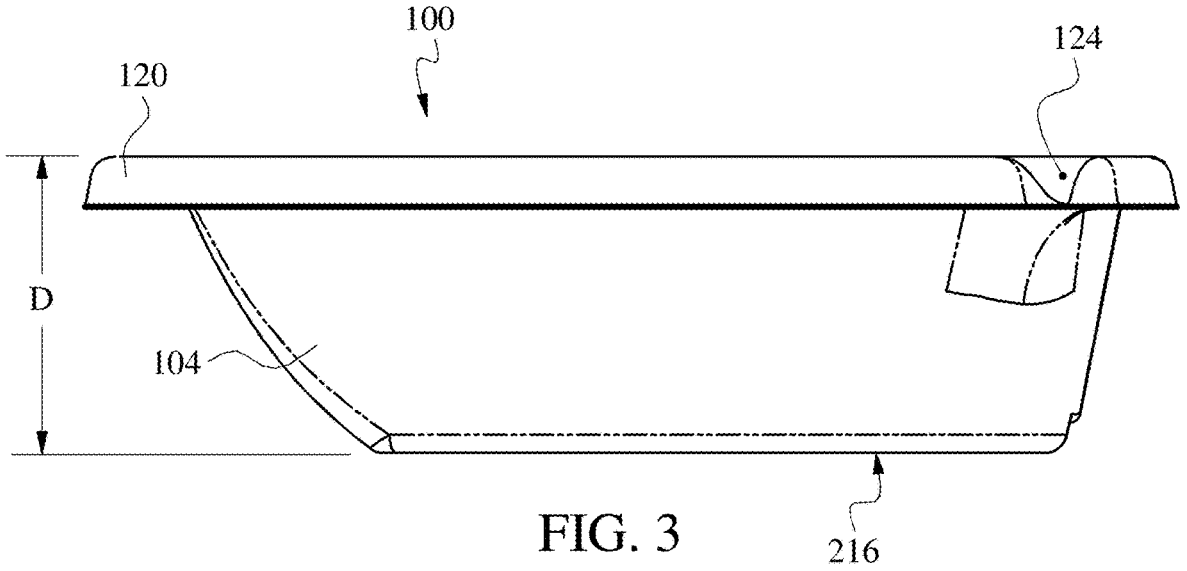
FIG. 3 is a left-side view of the embodiment in FIG. 1.

Note that the drawings are created from a computerized solid model of a currently preferred embodiment, and show various views of that same model. Consequently, while the drawing scale may change between different FIGs., the relative size of structure illustrated in each FIG. is internally consistent.

BEST MODE OF THE INVENTION

Reference will now be made to the drawings in which the various elements of the illustrated embodiments will be given numerical designations and in which the invention will be discussed so as to enable one skilled in the art to make and use the invention. It is to be understood that the following description is only exemplary of certain principles of the present invention, and should not be viewed as narrowing the claims which follow.

A currently preferred embodiment of a neonatal bath tub, generally indicated at 100, is illustrated in FIGS. 1 through 12. Tub 100 has a floor 102 disposed opposite an open top. The tub 100 includes a surrounding sidewall 104 that cooperates with floor 102 to define a fluid-holding volume 108. In the illustrated embodiment 100, a backrest, generally indicated at 112, protrudes like a peninsula into the volume 108, and forms extended fluid-holding side channels, or spaces, 116. The side channels 116 provide additional clearance between a baby and sidewall 104. The illustrated side channels 116 are open-topped and extend vertically from a tub supporting surface for fluid communication with tub volume 108. Side channels 116 also hold a quantity of additional water, and thereby, help to maintain the bath water at a consistent temperature over an extended period of time.

Figure 4:
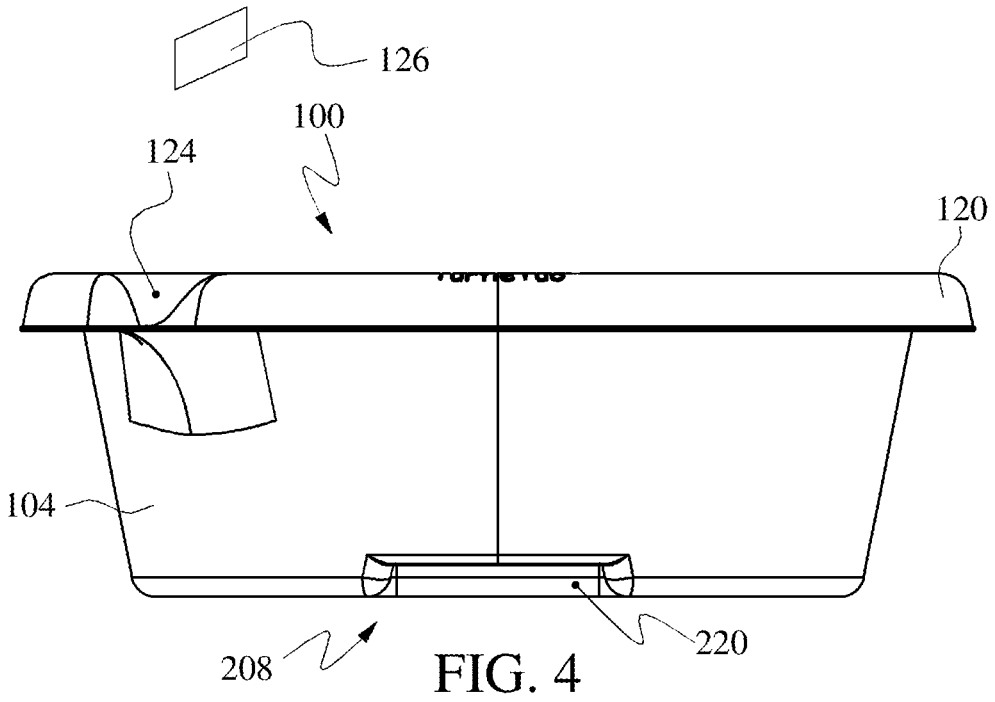
FIG. 4 is a front view in elevation of the embodiment in FIG. 1.
Figure 5:
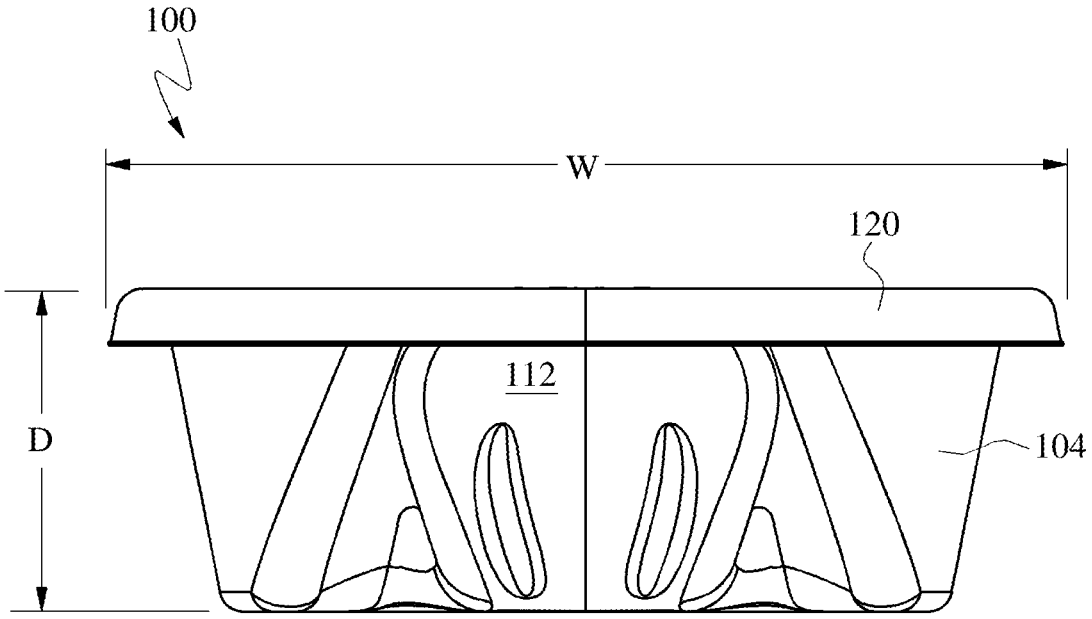
FIG. 5 is a rear view in elevation of the embodiment in FIG. 1.
Figure 6:
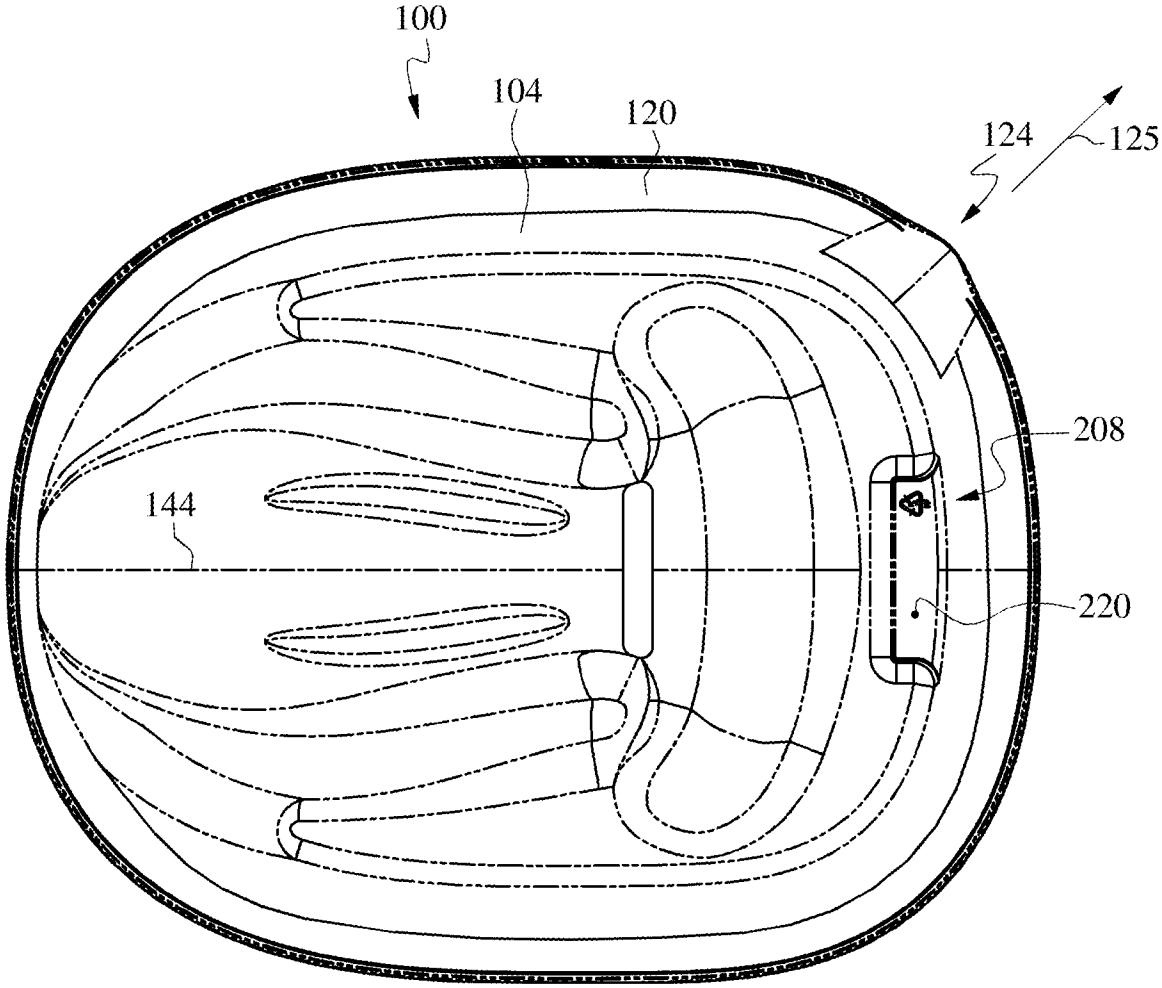
FIG. 6 is a bottom view of the embodiment in FIG. 1.
Figure 7:
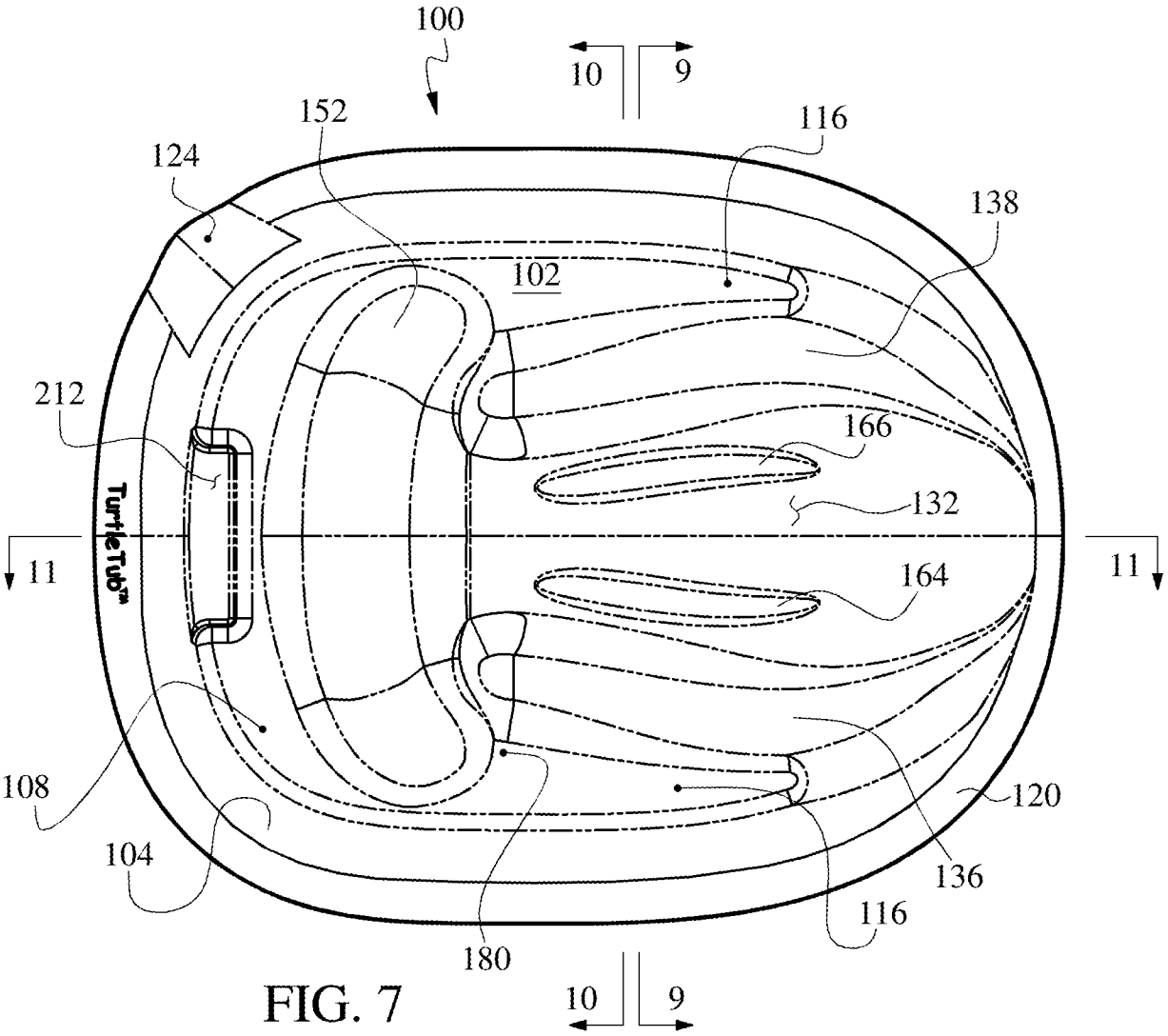
FIG. 7 is a top view of the embodiment in FIG. 1.
Figure 8:
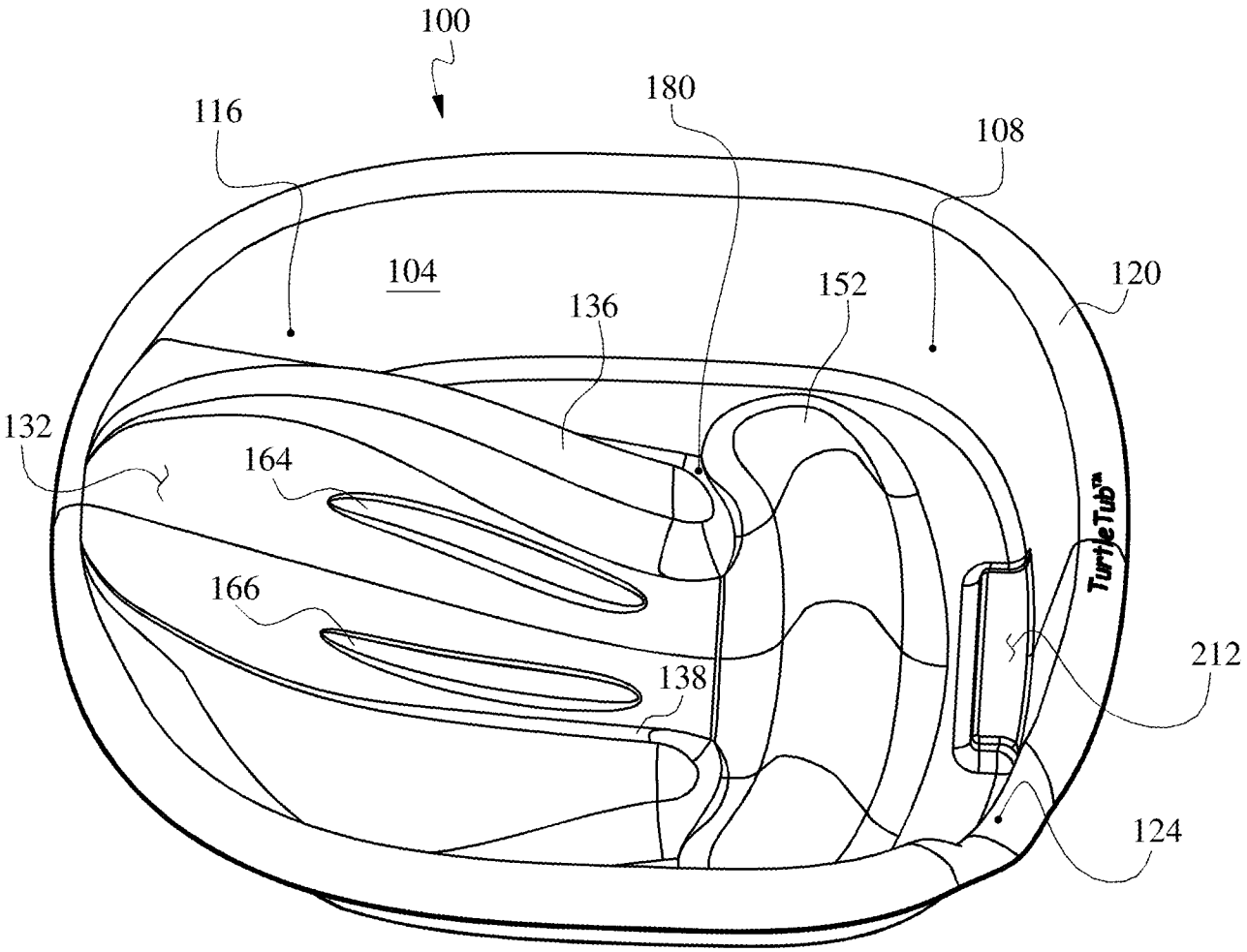
FIG. 8 is a lateral top view in perspective of the embodiment in FIG. 1.
Figure 9:
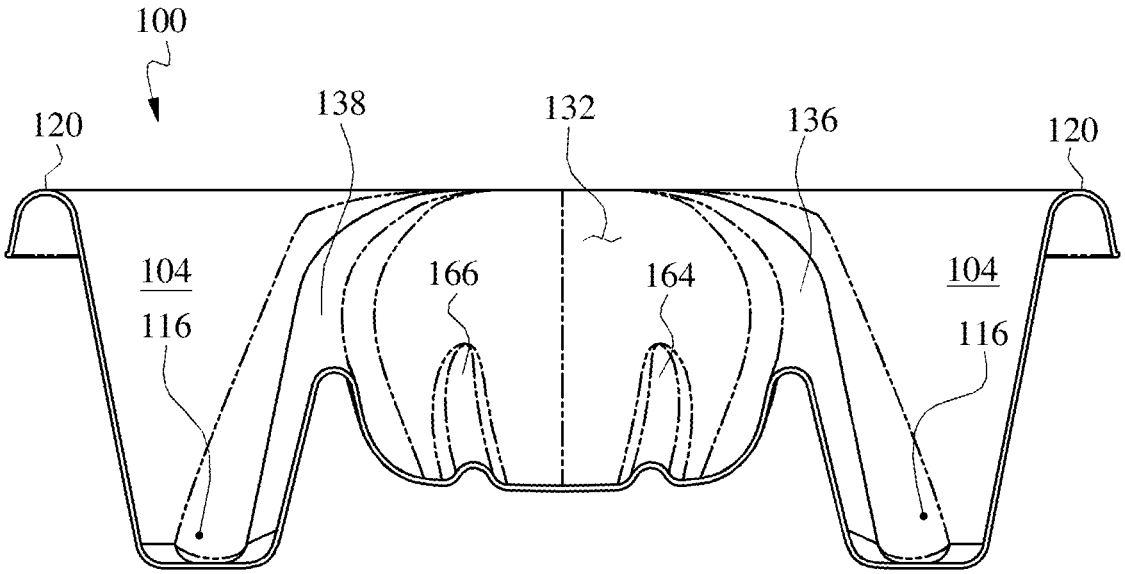
FIG. 9 is a section view in elevation of the embodiment in FIG. 7, taken at section 9-9 and looking in the direction of the arrows.

As illustrated, embodiments may include a rim 120 projecting generally from a top perimeter of the tub, the rim 120 being structured to facilitate lifting the tub 100 and a full load of water. Desirably, a spout 124 is disposed at a corner, or other convenient position, to facilitate emptying the tub 100. As illustrated in FIGS. 4 and 6, spout 124 facilitates pouring a fluid discharge in a direction definable by a vector 125 disposed in a vertical plane 126 that is anti-parallel to a tub centerline 144. Certain internal structures of the tub are desirably rounded to avoid crannies to facilitate cleaning the tub after use. Further, the internal tub structure is desirably configured and arranged to resist providing leverage to a baby's feet to avoid the baby turning over during bathing.

Backrest 112 may be characterized as a sloping backrest with a support surface 132 configured to support a baby at a defined inclined orientation inside the tub. A preferred backrest 112 provides a firm surface 132 against which the baby's spine may be urged toward a proscribed alignment. In contrast, a sling or hammock-style backrest provides an accommodating surface that inherently promotes curving the baby's back, or urging the baby toward a slumping posture.

The exemplary illustrated backrest 132 includes a first side support 136 and a second side support 138. The first and second side supports 136, 138 are spaced-apart on opposite sides of a tub length center-line 144 (FIG. 6) and operable to resist rotation of the baby in a plane approximately parallel to the backrest support surface 132 and about an axis 148 (FIG. 11) defined by a seat 152.

As illustrated in the preferred embodiment (e.g., see FIGS. 1, 9, and 10), side supports 136, 138 are spaced apart from side walls 104 of the tub 100 to define an extended water-holding channel 116 disposed at each side of the backrest 112. Workable embodiments of the first and second side supports 136, 138 may project by a maximum distance 153 of between about ½ inch and about 6 inches from a local plane 154. Plane 154 represents a portion of the support surface 132 of the backrest 112 that is local to a respective side support 136, 138. Sometimes, the first and second side supports 136, 138 project from the surface 132 of the backrest by a non-uniform distance along their length axes 156.

A backrest 112 may include a first stabilizer rib 164 and a second stabilizer rib 166, the first and second stabilizer ribs typically being spaced-apart on opposite sides of the tub length center-line 144 and disposed between the first and second side supports 136, 138. Desirably, stabilizer ribs 164, 166 are structured to enhance tub accommodation for a larger range in baby size by helping to provide lateral support for smaller babies, and don't get in the way or interfere with comfort of larger babies. Typically, the first and second stabilizer ribs 164, 166 project by a maximum distance of between about ¼ inch and about 1 inch from the support surface of the backrest. Sometimes the first and second stabilizer ribs 164, 166 project from the surface 132 of the backrest by a non-uniform distance along their length axes 168.

A stabilizing trough 170 is formed between side support 136 and side support 138. End portions of the illustrated side supports 136, 138 are disposed adjacent to seat 152. Consequently, trough 170 provides inherent stabilizing registration of a baby's torso and rear end with respect to the seat 152. In part, that is because the respective upstanding oppositely-disposed interference surfaces 171 (e.g., inner wall portions of side walls 136, 138), form a structural interference with the baby's torso and hips to resist transverse displacement of the baby's rear end from a generally central location on seat 152. Therefore, a baby's torso remains generally perpendicular to the seat 152, with the baby's rear end spaced apart from side edges of the seat 152. A similar trough 172 for smaller babies may be formed between stabilizer ribs 164, 166.

Figure 10:
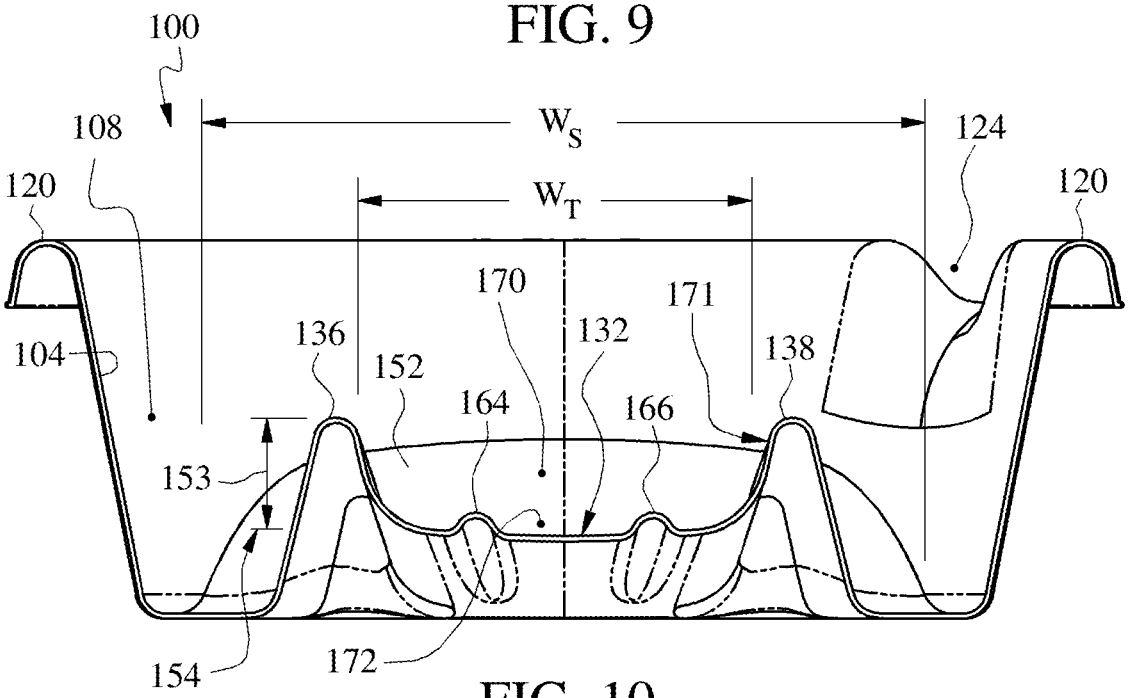
FIG. 10 is a section view in elevation of the embodiment in FIG. 7, taken at section 10-10 and looking in the direction of the arrows.

Note that the outer wall portions of illustrated upstanding side walls 136, 138 are spaced apart (at the same elevation) from fluid holding tub side walls 104 by open-topped side channels 116. Further, a trough width $W_T$ (defined between oppositely-disposed interference surfaces 171) at a location proximal to the seat 152 is smaller than a maximum seat width $W_S$. Said another way, the seat 152 desirably has a maximum seat width $W_S$ that is larger than a minimum trough width $W_T$ between upstanding facing inner walls (e.g., between oppositely-disposed interference surfaces 171) of the trough 170. In FIG. 10, it can be seen that the trough width $W_T$ of a currently preferred embodiment decreases with proximity to the seat (like a slight funnel). Note also that the backrest 112 and its backrest support surface 132 (e.g., illustrated in FIGS. 9 and 10) is an integral and non-removable part of the tub 100.

Figure 11:
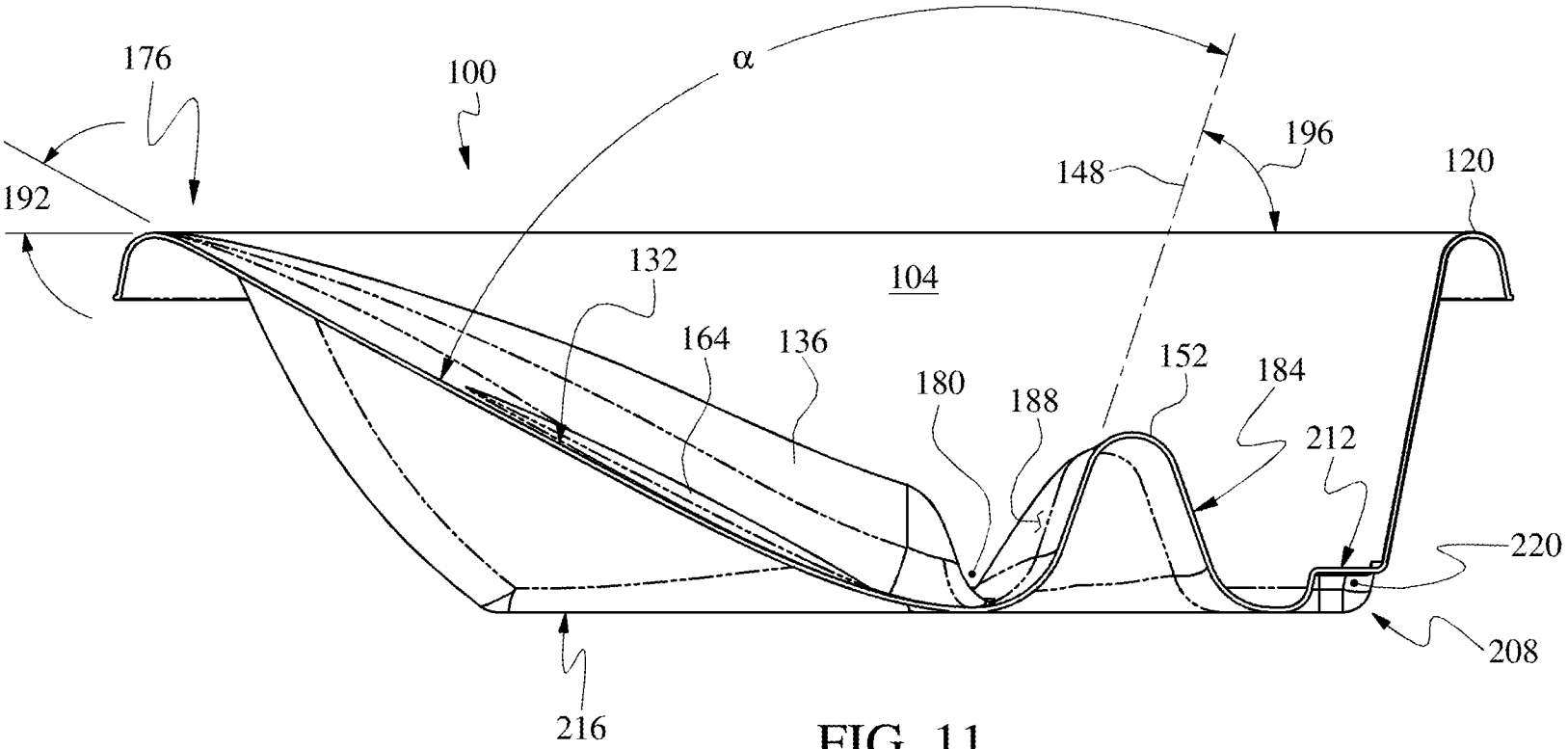
FIG. 11 is a section view in elevation of the embodiment in FIG. 7, taken at section 11-11 and looking in the direction of the arrows.

With particular reference now to FIG. 11, the top, generally indicated at 176, of a currently preferred backrest 112 is structured to blend smoothly into a top of a tub wall to avoid creating an interference with the heads of babies having different sizes. Also, it is preferred for a bottom of the backrest 112 to be structured to blend into the floor 102 of the tub 100, and at least one of the first side support and second side support to be spaced apart from an associated seat 152 to form a drain space 180 to resist creating a stagnant pool of fluid in which the baby sits during a bath. Such a drain space 180 provides a fluid flow path to facilitate maintenance of thermal equilibrium (e.g., a consistent temperature) throughout the fluid confined in the tub 100.

Desirably, a seat 152 is disposed to hold the baby at a hip-flexed position with respect to the backrest 112. One workable seat 152 includes a leg rest 184 integral with seat 152 and configured to flex the knees of the baby. One preferred seat 152 defines an arcuate shape projecting symmetrically in opposite directions from the tub center-line 144 and generally parallel to the floor 102. A currently preferred seat 152 projects from the floor 102 by about three inches. However, a seat may be alternatively sized as desired e.g., to accommodate to a baby of a particular size. That is, a shorter seat 152 may permit the knees of a smaller baby to bend. Preferably, the baby's rear end support surface 188 of a seat 152, at a section taken parallel to the tub floor, is concave.

Still with reference to FIG. 11, a preferred average backrest angle 192 is about 28 degrees, but can be varied by perhaps ±5, 10, 15, or 20 degrees, or so. It is currently preferred for the seat support surface 188 to form slightly less than a 90 degree angle $\alpha$ with respect to the backrest surface 132. The preferred acute angle $\alpha$ helps to stabilize the baby and to retain the baby in an installed position. In that case, the seat support surface angle 196 is slightly greater than complimentary to the backrest angle 192. As illustrated in FIG. 11, axis 148 is parallel to an approximate average of the seat support surface 188, and passes through centerline 144.

With reference now to e.g., FIG. 6, certain tubs 100 include rounded corners to suggest a generally oval plan form shape. A neonatal bath tub 100 typically has a length of less than about 30 inches, a width of less than about 24 inches, and a depth of less than about 10 inches. With reference to FIGS. 2, 3, 5, and 6, the currently preferred embodiment 100 has a plan form suggesting an ovaloid with a major axis length L (in a length direction) of about 23 inches, a minor axis length W (in a width direction) of about 18 inches, and a depth D of about 6½ inches. The preferred embodiment conveniently fits in warming beds, bassinets, on a counter next to a sink, and other locations where its use is desirable.

A workable tub 100 may be structured to permit stacking a plurality of tubs in a reduced volume. For example, an exemplary tub 100 may be manufactured from plastic, and can have a generally uniform tub wall configured as a single-layer shell having a thickness of about 0.1 inches, more or less. Workable plastics include polypropylene, polyethylene, PVC, ABS, and the like. Tubs 100 are currently being injection molded. Alternative methods of construction and operable materials will be readily apparent to one of ordinary skill.

In certain embodiments, and as illustrated, a step or offset, generally indicated at 208, may be formed in a portion of a tub wall or floor to provide an instrument surface 212 that is offset from a support surface on which the bottom 216 of a tub 100 is placed during use of the tub to wash a baby. A thermometer may be affixed inside the tub 100 to the instrument surface to permit a user to see the thermometer during use of the tub to wash a baby. Illustrated offset instrument surface 212 defines an air space 220 that insulates an installed thermometer from potential influence of the temperature of the support surface, and permits accurate measurement of water temperature. Desirably, surface 212 is arranged to orient a thermometer approximately horizontally. In that case, refraction of the water or an installed plastic liner does not interfere with visibility of the temperature readout.

Figure 12:
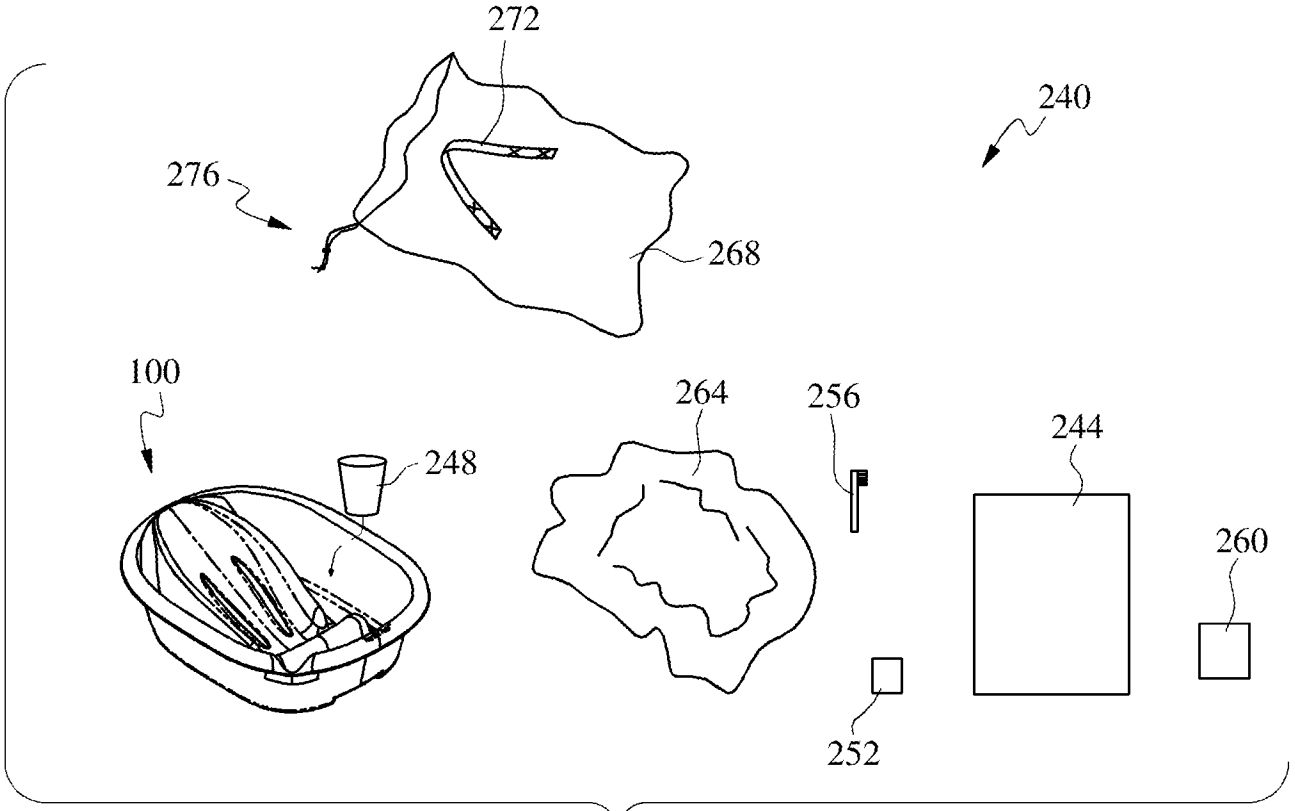
FIG. 12 is a schematic illustrating a system according to certain principles of the invention.

One embodiment provides a system, generally indicated in FIG. 12 at 240, for neonatal bathing. An exemplary such system 240 may include one or more of the following: a swaddle blanket 244; a container 248 sized to hold a quantity of rinse water in reserve and to fit inside a neonatal tub such that the rinse water remains substantially at the temperature of the bath water; a quantity of PH-neutral wash soap 252; a scalp brush 256; a neonatal-sized wash cloth 260; a water-proof liner 264 to fit the neonatal tub; and a storage bag 268 sized to contain the system and a neonatal tub, the storage bag being structured to permit hanging the storage bag at a convenient location when the storage bag is holding the system and a neonatal tub. As illustrated, a strap 272 may be provided to suspend a bag 268 from a hook, or, structure such as a drawstring, generally indicated at 276, may be used to tie off the bag to a suitable anchor.

It should be noted that a neonatal-sized wash cloth 260 is smaller in size than a conventional wash cloth, which is about 12 inches by 12 inches square. An exemplary neonatal-sized wash cloth 260 is sized about 4 inches by 4 inches square. However, a neonatal-sized washcloth 260 may be smaller or larger, up to perhaps 6 inches by 6 inches. Further, a neonatal-sized washcloth 260 is not required to be square.

Figure 13:
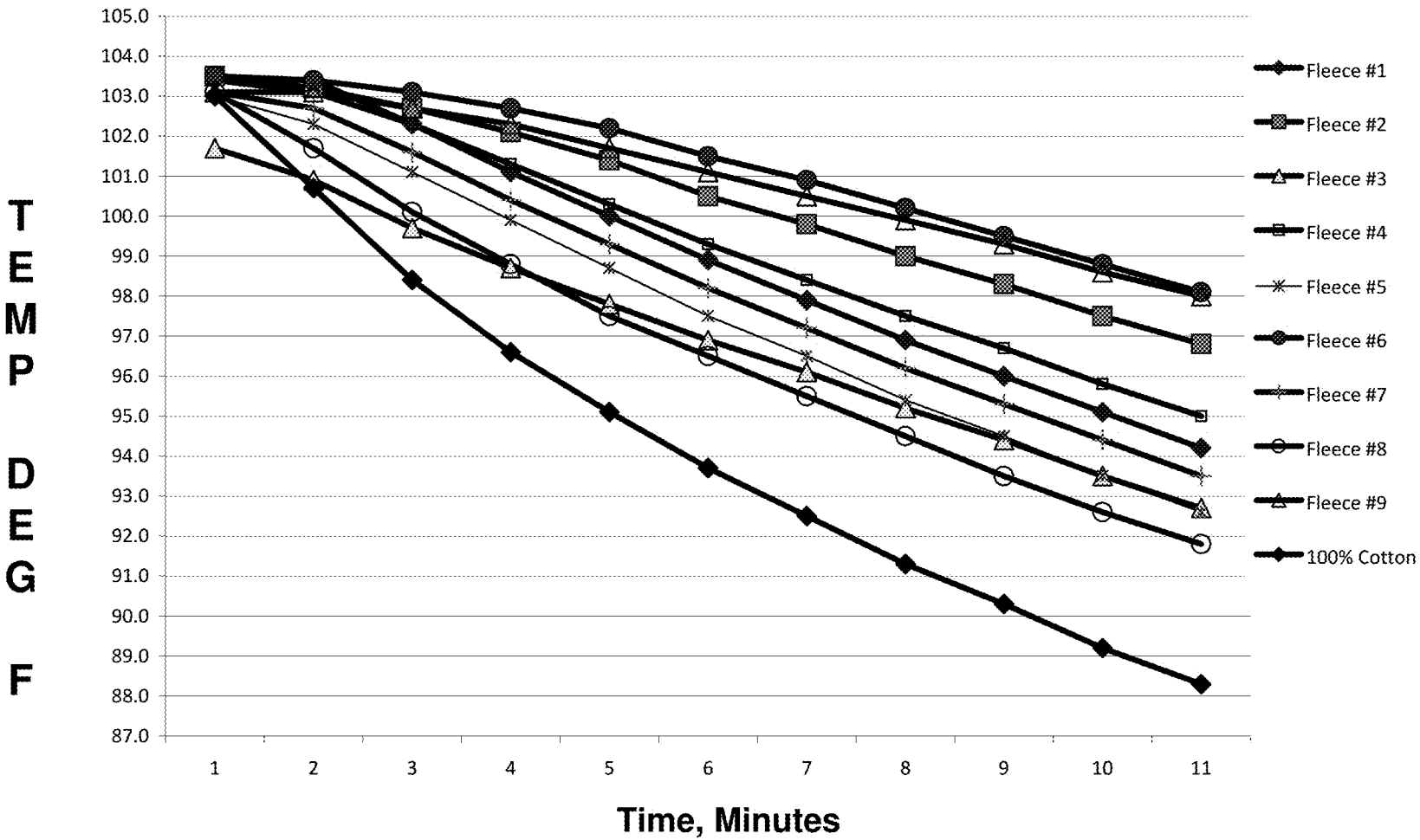
FIG. 13 is an X-Y plot of measured temperature over time for blanket heat-loss testing.

A currently preferred swaddle blanket 244 is made from a double-sided acrylic fleece material. Several candidate fleece materials were tested to determine their effectiveness compared to a cotton blanket. The stand-out and selected fleece candidate is fleece No. 6. Testing encompassed placing a thermocouple into a plastic quart-sized water bottle filled with water having the same temperature as water in a tub 100. The bottle was swaddled in one blanket like a baby, and the bundle was placed into a tub 100 that was filled with a bath quantity of warm water. The blanket was exchanged for one made from a different candidate material, and the water was replaced, for each successive test. Initial bath and bottle water temperature target was about 103 degrees F. (The initial water temperature in the test of fleece No. 3 was about 1 degree lower than the target, but the trend in temperature loss is still valid). Water temperature in the bottle was measured over time and recorded at increments of 1 minute. As illustrated in FIG. 13, the blanket desirably provides sufficient thermal insulation that the instrumented bottle of water drops in temperature by only about 5 degrees over the course of a 10 minute test. In contrast, a cotton blanket provided only slightly more than 2 minutes of equivalent thermal protection.

A disposable sterile liner 264 facilitates reuse of the tub 100. A currently preferred water-proof liner 264 is made from a transparent plastic membrane or film material that is arranged to form an oversized bag providing a depth slightly greater than the tub depth D. The open end of the bag can be wrapped around the perimeter of a tub 100 to hold the liner 264 in an installed position, and to provide a sterile surface everywhere that reasonably might contact a baby. It is desirable for the liner's material of construction to be selected and sized in thickness to form a membrane that may transversely flex, wrinkle, and/or variously conform to the angled inner surfaces of the tub 100. Water in a full tub 100 presses the preferred water-proof liner 264 against the various internal surfaces of the tub 100, and the liner 264 stays out of the way during an infant's bath or treatment. Desirably, a resilient elastic band or other snugging element urges the open bag end toward a retained engagement under the rim 120. A workable bag or liner 264 can be compared to an adult shower cap, although having much different dimensions and rather than shielding its user from water, the liner 264 traps and holds water for contact with a user.

While the invention has been described in particular with reference to certain illustrated embodiments, such is not intended to limit the scope of the invention. The present invention may be embodied in other specific forms without departing from its spirit or essential characteristics. The described embodiments are to be considered as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus, comprising:

a fluid-holding tub with a floor and an open top disposed opposite the floor, the tub having a length of less than about 30 inches, a width of less than about 24 inches, and a depth of less than about 10 inches;

a sloping backrest with a support surface configured to support a baby at a defined inclined orientation inside the tub;

a seat disposed to hold the baby at a hip-flexed position with respect to the backrest;

a first side support carried by the backrest and a second side support carried by the backrest, the first and second side supports being spaced-apart on opposite sides of a tub length center-line to define a stabilizing trough in which to receive a baby's back to register the baby orthogonally with respect to the seat, oppositely disposed upstanding inner side walls of the trough being configured to form a structural interference with a baby's hips to resist displacement of the baby's rear end in a width direction of the tub and toward a side edge of the seat, the trough to resist rotation of the baby in a plane approximately parallel to the backrest support surface and about an axis defined by the seat; and an extended water-holding open-topped side channel disposed at each left and right side of the backrest to space the first and second side supports apart from upstanding fluid-holding walls of the tub, each side channel extending along a length of the backrest and being in fluid communication with a volume defined inside the tub by way of a respective open channel end to avoid restriction of fluid flow in a tub length direction between each respective channel and the volume, wherein:

the seat has a maximum seat width that is larger than a minimum trough width between the inner side walls of the trough.

2. The apparatus according to claim 1, wherein:

the first and second side supports project in a generally vertical direction by a maximum distance of between about ½ inch and about 6 inches from the support surface of the backrest.

3. The apparatus according to claim 2, wherein:

the first and second side supports project from the surface of the backrest by a non-uniform distance along their length axes.

4. The apparatus according to claim 1, further comprising:

a first stabilizer rib and a second stabilizer rib, the first and second stabilizer ribs being spaced-apart on opposite sides of a tub length center-line and disposed between the first and second side supports, said first stabilizer rib and said second stabilizer rib projecting vertically from the support surface of the backrest to provide lateral torso support for smaller babies, the first and second stabilizer ribs projecting by a maximum distance of between about ¼ inch and about 1 inch from the support surface of the backrest.

5. The apparatus according to claim 4, wherein:

the first and second stabilizer ribs project from the surface of the backrest by a non-uniform distance along their length axes.

6. The apparatus according to claim 1, further comprising:

an underwater step providing an instrument surface that is offset from a support surface on which the tub is placed during use of the tub to wash the baby, the underwater step being structured and arranged to provide an airspace to insulate the instrument surface from temperature influence by the support surface.

7. The apparatus according to claim 6, further comprising:

a thermometer affixed to the instrument surface to dispose an indicator face of the thermometer approximately horizontally to permit a user to see the thermometer through the bathwater and/or a plastic liner during use of the tub to wash the baby.

8. The apparatus according to claim 1, comprising:

a rim projecting generally from a top perimeter of the tub, the rim being structured to facilitate lifting the tub and a full load of water.

9. The apparatus according to claim 1, wherein:

a top of the backrest is structured to blend smoothly into a top of a head end wall to avoid creating an interference with the heads of babies having different sizes.

10. The apparatus according to claim 1, wherein:

a bottom of the backrest is structured to blend into the floor of the tub; and at least one of the first side support and second side support is spaced apart from the seat to form a drain space for fluid flow in a transverse direction from the seat to a side channel to resist creating a stagnant pool of fluid in which the baby is disposed and to facilitate maintenance of thermal equilibrium in the fluid confined in the tub.

11. The apparatus according to claim 1, wherein:

the seat has an integral leg rest configured to flex the knees of the baby.

12. The apparatus according to claim 1, wherein:

the seat comprises a baby-support surface with an arcuate shape projecting symmetrically in opposite directions from the tub center-line and generally parallel to the floor.

13. The apparatus according to claim 12, wherein:

the baby-support surface of the seat, at a horizontal section taken through the middle of the baby-support surface, is concave with a center of curvature disposed on the babies' head-side of the seat.

14. The apparatus according to claim 1, wherein:

internal structures of the tub are rounded to avoid crannies and configured and arranged to resist providing leverage to a baby's feet to avoid the baby turning over during bathing.

15. The apparatus according to claim 1, wherein:

the tub has rounded corners to suggest a generally oval planform shape.

16. The apparatus according to claim 1, wherein:

the tub and backrest are structured as a one-piece shell having walls of substantially uniform thickness disposed between the floor and the open top, the walls defining a horizontally-disposed inside cross-section that increases in area in correspondence with increased distance in a vertical direction moving from the floor toward the open top to permit stacking a plurality of tubs in a reduced volume with an inside sidewall surface of a lower tub to support an outside sidewall surface of its adjacent upper tub.

17. The apparatus according to claim 1, further comprising:

a water-holding liner arranged to form an oversized bag providing a depth slightly greater than the tub depth, an open end of the bag being structured to wrap around the perimeter of a tub rim to hold the liner in an installed position, the installed liner being structured to provide a contact surface everywhere that reasonably might contact a baby, the liner being formed from a material sized in thickness to form a membrane that may transversely flex, wrinkle, and/or variously conform to the angled inner surfaces of the tub such that water in a full tub presses the liner against the various internal surfaces of the tub, with a resilient snugging element disposed to act on the bag end in a perimeter bag direction and urge the open bag end toward an open-end aperture size having an area less than a planform area defined by the tub rim to cause a retained engagement of an end portion of the bag end under the rim, wherein the instrument surface is disposed to orient an installed thermometer approximately parallel to the surface of water in the tub during use of the tub to bathe the baby.

18. The apparatus according to claim 12, wherein:

a portion of the baby-support surface of the seat is disposed at an acute angle with respect to a portion of the backrest support surface.

19. The apparatus according to claim 1, wherein:

the apparatus has a planform suggesting an ovaloid with a major axis length of about 23 inches, a minor axis length of about 18 inches, and a depth of about 6½ inches.

20. An apparatus, comprising:

a fluid-holding tub with a floor and an open top disposed opposite the floor, the tub having a length of less than about 30 inches, a width of less than about 24 inches, and a depth of less than about 10 inches;

a sloping backrest with a support surface configured to support a baby at a defined inclined orientation inside the tub, the backrest being an integral non-removable part of the tub;

a seat disposed to hold the baby at a hip-flexed position with respect to the backrest; and a first side support and a second side support, the first and second side supports being carried by the backrest and spaced-apart on opposite sides of a tub length center-line to define a stabilizing trough in which to receive the baby's back to register the baby orthogonally with respect to the seat, upstanding facing inner side walls of the trough being configured to form a structural interference with a baby's hips to resist displacement of the baby's rear end in a width direction of the tub and toward a side edge of the seat, the trough to resist rotation of the baby in a plane approximately parallel to the backrest support surface and about an axis defined by the seat, wherein:

the seat has a maximum seat width that is larger than a minimum trough width between the facing inner sidewalls.

* * * * *